US008907807B2

(12) United States Patent
Huang et al.

(10) Patent No.: US 8,907,807 B2
(45) Date of Patent: Dec. 9, 2014

(54) SECURITY SYSTEM POWER MANAGEMENT

(71) Applicant: Oplink Communications, Inc., Fremont, CA (US)

(72) Inventors: Longgang Huang, San Jose, CA (US); Keqin Gu, Fremont, CA (US); Qiang Xie, Wuhan (CN); Kuochun Lee, Fremont, CA (US)

(73) Assignee: Oplink Communications, Inc., Fremont, CA (US)

( * ) Notice: Subject to any disclaimer, the term of this patent is extended or adjusted under 35 U.S.C. 154(b) by 7 days.

(21) Appl. No.: 13/838,232

(22) Filed: Mar. 15, 2013

(65) Prior Publication Data

US 2014/0266767 A1 Sep. 18, 2014

(51) Int. Cl.

| | |
|---|---|
| ***G08B 3/00*** | (2006.01) |
| ***G08B 13/22*** | (2006.01) |
| ***G08B 29/18*** | (2006.01) |
| *G08B 25/10* | (2006.01) |

(52) U.S. Cl.

CPC ..... *G08B 13/22* (2013.01); *G08B 29/181* (2013.01); *G08B 25/10* (2013.01)

USPC ..... 340/693.2; 340/426.24; 340/506

(58) Field of Classification Search

USPC ..... 340/693.2, 506, 635, 517, 511, 501, 340/426.24, 426.25, 521, 428

See application file for complete search history.

(56) References Cited

U.S. PATENT DOCUMENTS

| | | | | |
|---|---|---|---|---|
| 4,438,403 | A * | 3/1984 | Schweitzer, Jr. | 324/133 |
| 6,373,150 | B1 * | 4/2002 | Fuller | 307/39 |
| 2002/0183865 | A1 * | 12/2002 | Ichikawa et al. | 700/15 |
| 2003/0128114 | A1 * | 7/2003 | Quigley | 340/506 |
| 2007/0023499 | A1 * | 2/2007 | Wurzburg et al. | 235/376 |
| 2007/0257807 | A1 * | 11/2007 | Darr | 340/635 |
| 2010/0001586 | A1 * | 1/2010 | Bernard et al. | 307/65 |

* cited by examiner

*Primary Examiner* — Daniel Previl

(74) *Attorney, Agent, or Firm* — Fish & Richardson P.C.

(57) ABSTRACT

Methods, systems, and apparatus, including computer programs encoded on computer storage media, for power management. One of the methods includes determining that there is a loss in electricity to a security system management device; entering low power state; receiving a wireless sensor alert while in the low power state; in response to the alert: returning to normal power state to transmit an alarm to a service provider system, and returning to low power state after transmitting the alarm; and returning to normal power state when electricity is restored.

14 Claims, 4 Drawing Sheets

SECURITY SYSTEM POWER MANAGEMENT

BACKGROUND

This specification relates to power management.

Conventional home security systems operate using an external electrical source, e.g., a connection to an electrical outlet of a home electrical system. Some home security devices include a battery backup that allows the respective devices to maintain function when the external power is lost. However, a device operating on battery typically operates at full functionality and has a limited lifespan based on battery capacity.

SUMMARY

In general, one innovative aspect of the subject matter described in this specification can be embodied in methods that include the actions of determining that there is a loss in electricity to a security system management device; entering low power state; receiving a wireless sensor alert while in the low power state; in response to the alert: returning to normal power state to transmit an alarm to a service provider system, and returning to low power state after transmitting the alarm; and returning to normal power state when electricity is restored. Other embodiments of this aspect include corresponding computer systems, apparatus, and computer programs recorded on one or more computer storage devices, each configured to perform the actions of the methods. A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

The foregoing and other embodiments can each optionally include one or more of the following features, alone or in combination. Entering the low power state includes powering down one or more of a cellular communications, WiFi, Ethernet, WIMAX or other wireless/wired networking modules. The wireless sensor alert is a radio frequency alert received from one or more security sensors. The sensors include one or more of movement or displacement sensors. Entering the low power state includes closing respective switches to communication modules. The security system management device includes a USB hub coupling one or more communication modules to a management module and wherein entering low power mode includes disconnecting the USB hub and communication modules from a battery backup for the security system management device. Transmitting the alarm to the service provider system includes selectively activating at least one of the communication modules to transmit the alarm.

In general, one innovative aspect of the subject matter described in this specification can be embodied in methods that include the actions of determining that there is a loss in electricity to a security system management device; transmitting a message to one or more wireless enable devices to enter a low power state; entering a low power state for the security system management device; receiving a wireless sensor alert while in the low power state; in response to the alert: returning to a normal power state, transmitting a message to a wireless camera device to capture content, receiving captured wireless camera content, transmit an alarm to a service provider system including the captured wireless camera content, and returning to the low power state after transmitting alarm; and returning to the normal power state when electricity is restored. Other embodiments of this aspect include corresponding computer systems, apparatus, and computer programs recorded on one or more computer storage devices, each configured to perform the actions of the methods. A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

The foregoing and other embodiments can each optionally include one or more of the following features, alone or in combination. Entering the low power state includes powering down one or more of a cellular communications, WiFi, Ethernet, WIMAX or other wireless/wired networking modules. The wireless sensor alert is a radio frequency alert received from one or more security sensors. The sensors include one or more of movement or displacement sensors. Entering the low power state includes closing respective switches to communication modules. The security system management device includes a USB hub coupling one or more communication modules to a management module and wherein entering low power mode includes disconnecting the USB hub and communication modules from a battery backup for the security system management device.

In general, one innovative aspect of the subject matter described in this specification can be embodied in a security management device that includes a management module configured to provide security and power management to a security system; one or more communication modules coupled to the management module; an RF transmitter/receiver configured to communicate with devices coupled to the security system; a battery backup power supply; and multiple switches, the one or more switches positioned in an electrical path of each of the communication modules, wherein the management module is configured to control the multiple switches in a low power state to selectively cut battery power to the communication modules Particular embodiments of the subject matter described in this specification can be implemented so as to realize one or more of the following advantages. A security system can maintain a degree of functionality over a longer period of time in power loss situations.

The details of one or more embodiments of the subject matter of this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
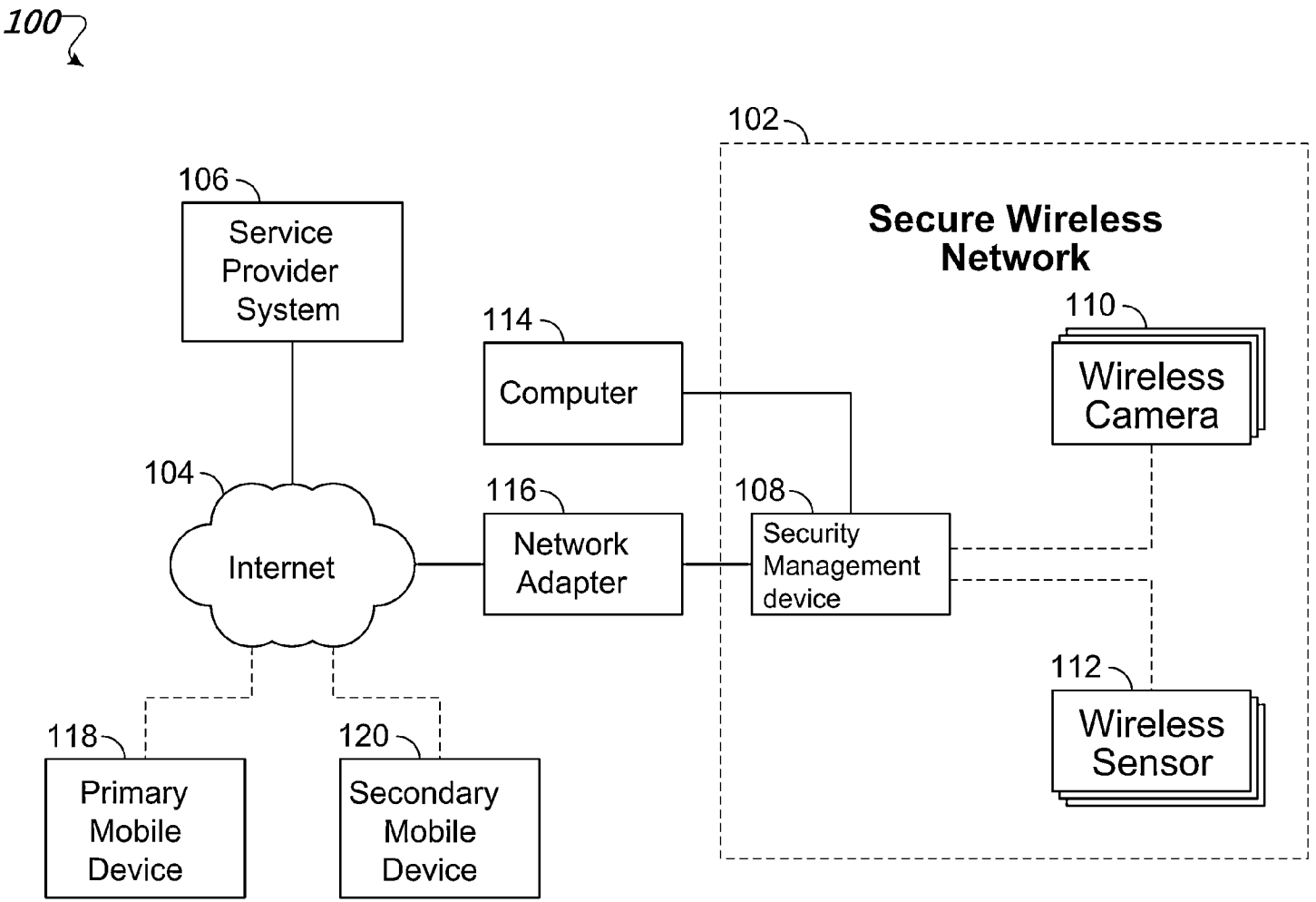
FIG. 1 is a diagram of an example security system.

FIG. 1 is a diagram of an example security system 100. The security system 100 includes a secure wireless network 102, which is connected through the Internet 104 to a service provider system 106.

The secure wireless network 102 includes a security management device 108 and wireless enabled devices 110, 112. The security management device 108 can be an access point device. The wireless enable devices 110, 112 can be preprogrammed with respective keys. In some implementations, the security management device 108, optionally in conjunction with the service provider system 106, can determine and use the appropriate keys to configure the wireless enabled devices 110, 112 thereby establishing a self-configured secure wireless network 102 with minimal or no user interaction.

In a typical home security system, several strategically positioned cameras 110 and sensors 112 may be included. In addition to sensors included for security purposes such as movement and displacement sensors, for example, detecting the opening of doors and windows, other sensors providing other useful information may be included such as doorbell sensors, smoke detector alarm sensors, temperature sensors, and/or environmental control sensors and/or controls.

In this example, the security management device 108 includes a router for the home security system. Therefore, all devices that are to be networked are communicatively coupled to the security management device 108. To this end, the security management device includes at least one of an Ethernet receptacle or Universal Serial Bus (USB) receptacle so that various devices such as a computer 114 may be wire-coupled to it, e.g., through an Ethernet connection. The security management device 108 is configured to be in "router" mode. As such it can be referred to as being a router security management device.

The security management device 108 is communicatively coupled, e.g., through an Ethernet connection, to a network adapter 116, e.g., a modem or directly to the Internet through an ISP. In some implementations, a broadband connection is used for high speed transmission of video data from the one or more wireless cameras and sensor data from the wireless sensors. The security management device 108 can include a Dynamic Host Configuration Protocol (DHCP) server which is configured to assign IP subaddresses to devices connecting through the security management device 108 to the Internet 104.

In some implementations, the security management device 108 includes a software agent residing in it that establishes communication with a remote service provider system 106 upon the security management device 108 being powered up and after it has been joined to the Internet 104 through the network adapter 116, which serves as an Internet gateway. The service provider system 106 interacts with the security management device 108 and authorized devices, e.g., primary and secondary mobile devices 118 and 120, to perform various functions and/or services.

The mobile devices 118 and 120 can include software agents or resident applications for such interaction with the service provider system 106. Devices that are attempting to interact with the service provider system 106 may confirm their authority to the service provider system 106, for example, by providing information that uniquely identifies the requesting device, e.g., an Internet Protocol (IP) address, a product serial number, or a cell phone number. Alternatively, they may provide a user name and password which are authorized to interact with the secure wireless network 102. To facilitate such authorization procedures, the service provider system 104 can store or have ready access to such authorization information for each secure wireless network of users who subscribe to the service. The mobile devices 118 and 120 can be used to receiving information from the security system, e.g., alarm information, as well as used to control functions of the security system.

Figure 2:
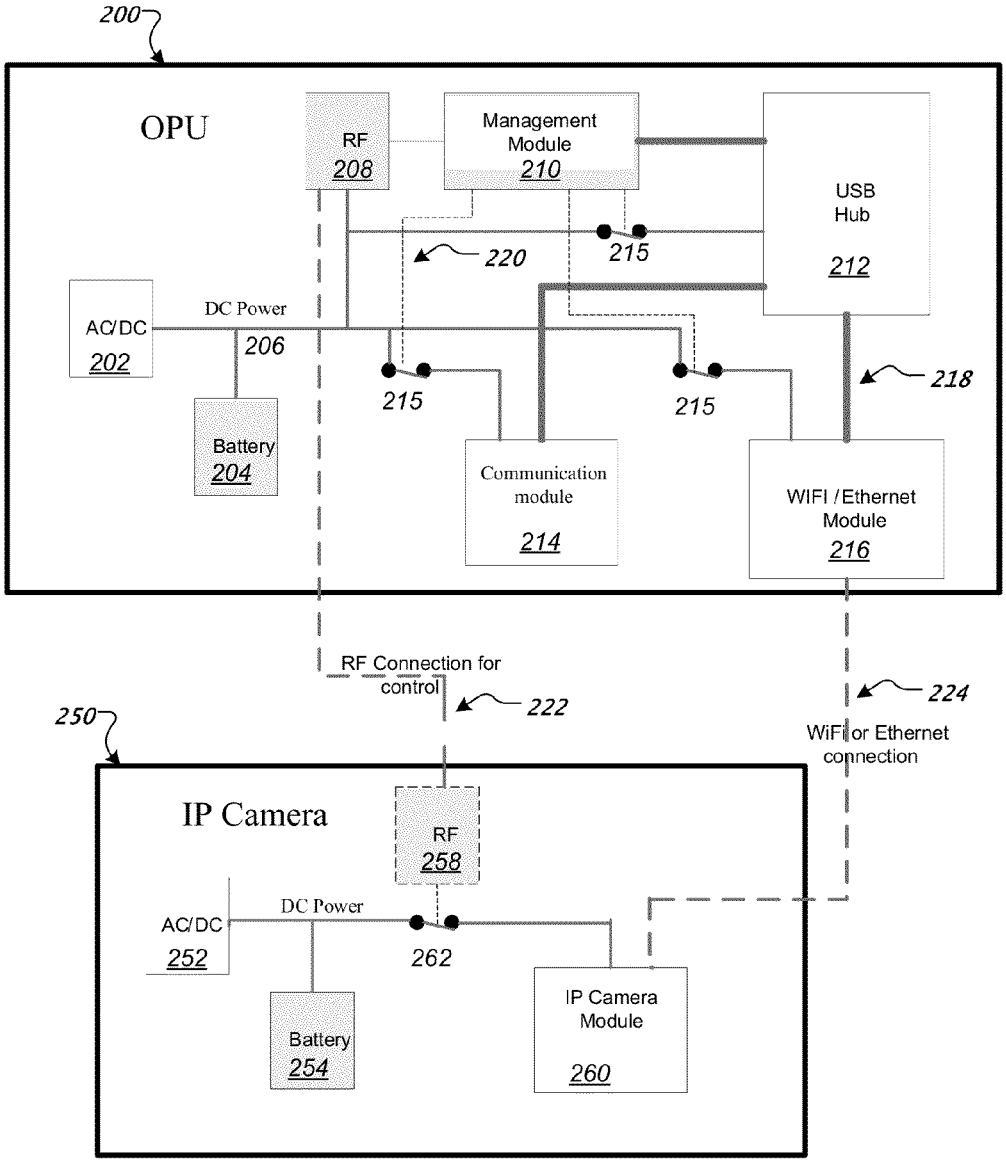
FIG. 2 is a diagram of an example security management device.

FIG. 2 is a diagram of an example security management device 200. The security management device 200 can be, for example, the security management device 108 for managing secure wireless network 102 of FIG. 1.

The security management device 200 includes AC/DC converter 202, battery 204, DC power lines 206, Radio Frequency transmitter/receiver 208, management module 210, Universal Serial Bus "USB" hub 212, 3G dongle 214, WiFi/Ethernet module 216, and communication paths 218.

In particular, the AC/DC converter 202 receives external AC power, e.g., from an electrical outlet or direct wiring to a home wiring system. The AC/DC converter 202 converts the incoming alternating current to direct current having a suitable power characteristics e.g., voltage and current.

When the external AC power is unavailable, e.g., due to an electrical system outage, the battery 204 can provide direct current to the security management device 200. The battery can be of any suitable type and configuration including, for example, lithium ion as well as nickel and cadmium based batteries. The battery 204 can be rechargeable or non-rechargeable. The DC power from the AC/DC converter 202 or the battery 204 is delivered to using DC power lines 206.

The management module 210 manages security system functionality including, for example, configuring and managing wireless enabled devices including sensors and camera devices. The management module 201 also provides alerts to one or more of a service provider system, e.g., service provider system 104 of FIG. 1, or a mobile device associated with the security system, e.g., a user's mobile phone, e.g., mobile devices 118, 120 of FIG. 1. Similarly, the management module 201 can receive instructions from authorized mobile devices and the service provider system.

The management module 210 also provides power management functions. The power management functions can include controlling one or more switches 215, e.g., using control lines 220, cutting power to particular communication modules, e.g., communication module 214 or WiFi module 216, as well as the USB hub 212. Techniques for performing power management are described in greater detail below in particular with respect to FIGS. 3 and 4.

The communication modules are coupled to the management module 210 using the USB hub 212. Thus, the USB hub 212 routes communications between the management module 210 and the respective communication modules, e.g., using communication lines 218. In some implementations, the USB hub can be a switch array or other suitable communication switch, adapter, or interconnection device.

The communication modules include cellular communication module 214. The cellular communication module 214 can provide 2G, 3G, and or 4G telecommunications technology, configured to transmit and receive data to/from the service provider system. For example, the telecommunications technology can use various wireless protocols including GSM, CDMA, or WIMAX. The cellular communication module 214 can include a 2G/3G/4G dongle. The 3G/4 G communication module 214 can be a combination 2G/3G/4G dongle or a combination of one or more of a 2G, 3G or 4G dongle. For example, the management module 210 can instruct the cellular communication module 214 to send alarm data to the service provider system in response to an alert from a security system device, e.g., a window sensor.

The communication modules also include a WiFi/Ethernet module 216. The WiFi/Ethernet module 216 can include a wired Ethernet connection to a network, e.g., the Internet. The Ethernet connection can be used to communicate with the service provider system in a similar manner to the 3G/4G dongle 214. The WiFi/Ethernet module 216 also includes capabilities for communication with one or more wireless enabled devices included in the security system. For example, one or more IP cameras can be included in the security system. Video data captured by an IP camera (e.g., video, a video clip, or one or more still images generated from video, can be transmitted by WiFi to the wife/Ethernet module 216 for transmission to the service provider system or to one or more authorized mobile devices.

The RF transmitter/receiver 208 is configured to transmit RF control signals, as instructed by the management module 210, to respective sensors, cameras, and other devices included in the security system. The RF transmitter/receiver 208 is also configured to receive alerts or other communications from the respective sensors, cameras, and other devices. The RF transmitter/receiver can use any suitable RF wireless protocol, in particular those used in home security and automation including, for example, 433 MHz, 426 MHz, 868 MHz, Zwave, Zigbee, WiFi, etc.

FIG. 2 includes an example IP camera 250. The IP camera can be configured as part of the security system. For example, the IP camera 250 can be positioned near a front door of a home as part of a home security system. The IP camera 250 includes AC/DC converter 252, battery 254, DC power lines 256, RF transmitter/receiver 258, and IP camera module 260.

The AC/DC converter 252, battery 254, and DC power lines 256 operate in a similar manner as described above with respect to the management module 200. The RF transmitter/receiver 258 is configured to transmit receive RF control signals from the management module 200. Additionally, in some implementations, the RF transmitter/receiver 258 sends acknowledgement signals to the management module 200.

The IP camera module 260 includes components for capturing, storing, and transmitting video data. For example, the IP camera module 260 can include conventional camera optics for capturing video data, one or more storage devices, e.g., flash or other computer readable media, and WiFi transmission components for transmitting video data, e.g., to the management module 200. The IP camera module 260 can include additional components, for example, a processor and software for processing video data. For example, the IP camera module 260 can be configured to generate a video clip of a specified duration or to extract a specified number of still images from video data.

In some implementations, the RF transmitter/receiver 258 receives control commands from the management module 200 instructing the IP camera 250 to enter a low power mode. In response to the command, the IP camera 250 can trigger a switch 262 in the DC power lines 256 to cut power to the IP camera module 260. The IP camera 250 can alternatively receive the control command from the WiFi or Ethernet connection 216 prior to the management module 210 powering it down. Similarly, the IP camera 250 can trigger the switch 262 to restore power in response to another command or in response to one or more events, e.g., restoration of AC power. Low power management of an IP camera is described in greater detail below with respect to FIG. 4.

Figure 3:
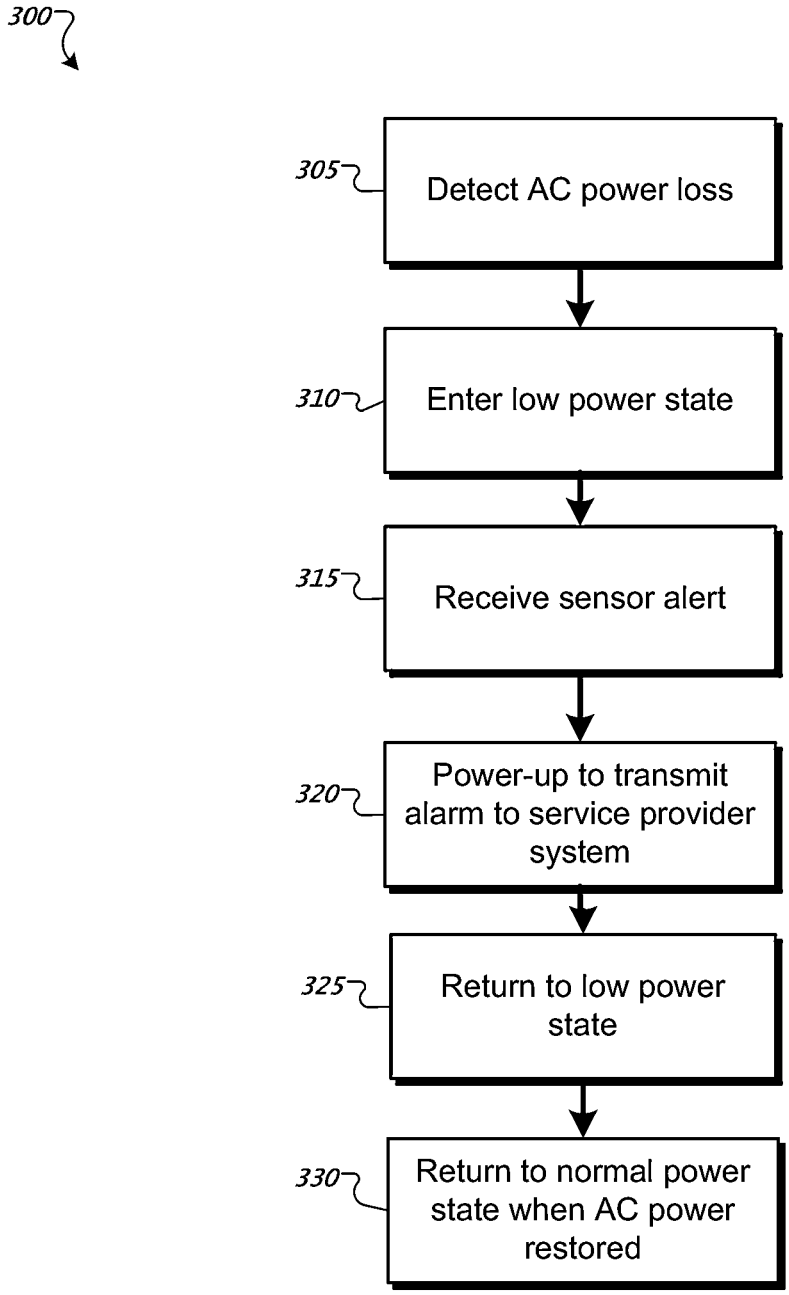
FIG. 3 is a flowchart of an example method of security system power management.

FIG. 3 is a flowchart of an example method 300 of security system power management. For convenience, the method 300 will be described with respect to a security management device, e.g., the security management device 200 of FIG. 2, that performs the method 300.

The security management device detects an AC power loss (305). When the AC power loss occurs, the device initiates the battery, which provides a backup supply of electricity. The AC power loss can be detected, for example, in response to a local power failure that cuts electricity to a home or business in which the security system is installed.

The security management device enters a low power state (310). Entering the low power state includes powering down communication modules. For example, if the security management device includes communication module, such as a 3G or 4G dongle, a WiFi module, or an Ethernet module, each can be powered down. Additionally, the security management device can include a USB hub that communicatively couples the communication modules to a management module. The USB hub can also be powered down. Powering down these modules of the security management device can extend the time of the battery power backup.

In some implementations, the management module signals one or more switches to open in the DC power disconnecting the communication modules and the USB module, if present, from the power supply. In some alternative implementations, each communication module includes logic allowing the modules to self-power down in response to a command from the management module.

The security management device receives a sensor alert (315). The sensor alert can be received as an RF signal from a security system sensor. As described above, the sensor can be, for example, a movement or displacement sensor. Each sensor can include an independent battery backup maintaining operation of the sensor after a power failure. When a sensor is triggered, for example a motion sensor senses movement, the sensor notifies the security management device using an RF communication. The security management device includes an RF receiver that receives the incoming signal.

In response to the received sensor alert, the security management device powers up one or more communication modules to transmit an alarm to a service provider system (320). In particular, the management module can activate switches necessary to provide power and communication to one or more particular communication modules needed to transmit the alarm. For example, the security management device can close one or more switches sending power back to cellular communication module e.g., cellular communication module 214. Alternatively, the dongle can provide another form of cellular data communication. The security management device may also need to switch on a USB hub to allow the management module to communicate with the cellular communication module. However, in other implementations the communication module is directly wired to the management module. The management module then uses the activated cellular communication module to transmit information about the alarm to a service provider system.

In some implementations, the management module processes the alert to determine whether it triggers an alarm, e.g., based on a set of rules or other criteria. In such scenarios, the security management device only powers up when the alarm is triggered.

After the alarm has been transmitted, the security management device returns to the low power state (325). When the security management device detects that the AC power has been restored, the security management device returns to a normal power state (330).

In some alternative implementations, the security management device enters a low power state, even when the AC power is maintained, if specified criteria occur. For example, the security management device can enter the low power state if an Ethernet connection to the Internet is lost for a specified period of time.

Figure 4:
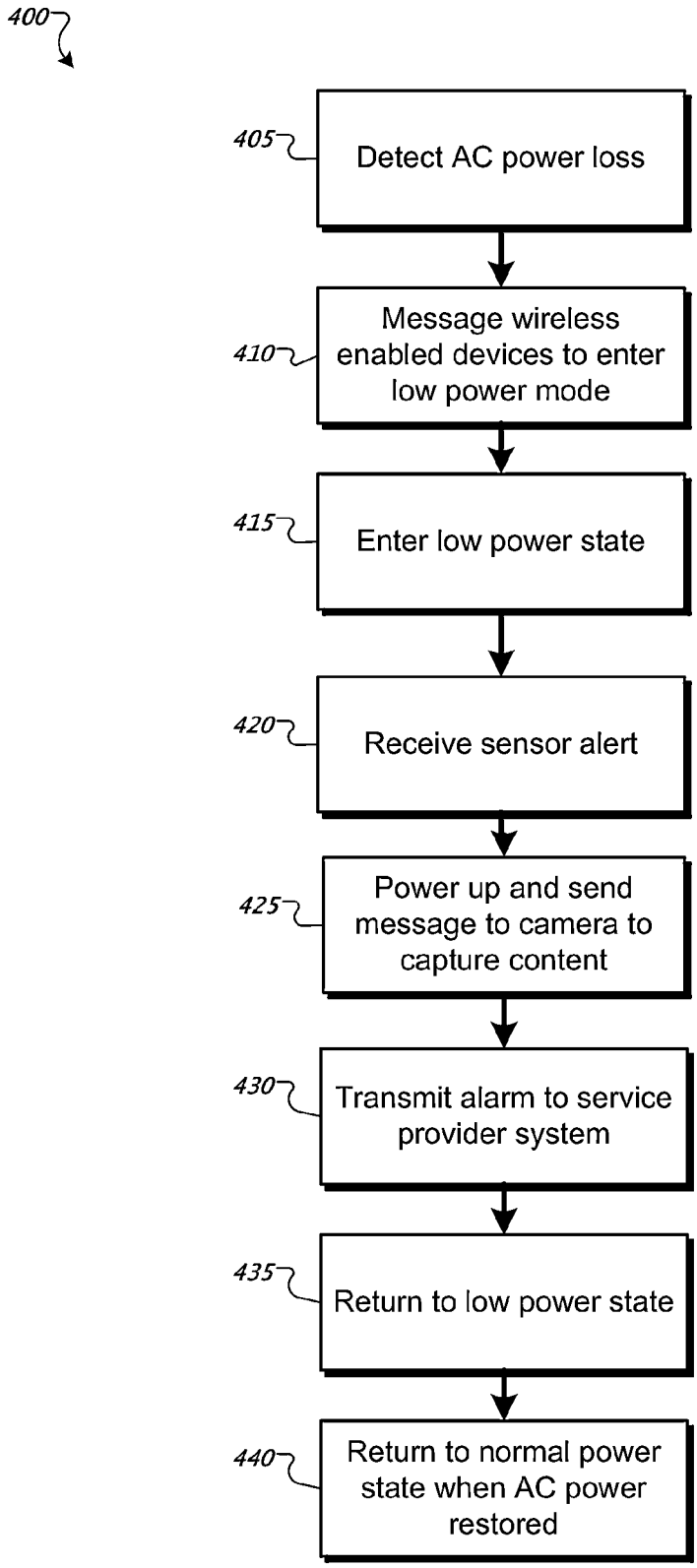
FIG. 4 is a flowchart of another example method of security system power management.

FIG. 4 is a flowchart of another example method 400 of security system power management. For convenience, the method 400 will be described with respect to a security management device, e.g., the security management device 200 of FIG. 2, that performs the method 400.

The security management device detects an AC power loss (405). When the AC power loss occurs, the device initiates the battery, which provides a backup supply of electricity. The AC power loss can be detected, for example, in response to a local power failure that cuts electricity to a home or business in which the security system is installed.

The security management device transmits an instruction to one or more wireless enabled devices that are part of the security system to enter a low power state (410). In particular, the security management device can transmit an RF or WiFi control instruction to one or more IP cameras instructing them to enter a low power state. In the low power state, an IP camera can disable particular functions including camera recording to conserve battery life. For example, the IP camera can enter a low power state by disconnecting an IP camera module as described above with respect to FIG. 2.

The security management device enters a low power state (415). Entering the low power state includes powering down communication modules. For example, if the security management device includes cellular communication circuitry, a WiFi module, or an Ethernet module, each can be powered down. Additionally, the security management device can include a USB hub that communicatively couples the communication modules to a management module. The USB hub can also be powered down. Powering down these modules of the security management device can extend the time of the battery power backup.

In some implementations, the management module signals one or more switches to open in the DC power disconnecting the communication modules and the USB module, if present, from the power supply. In some alternative implementations, each communication module includes logic allowing the modules to self-power down in response to a command from the management module.

The security management device receives a sensor alert (420). The sensor alert can be received as an RF signal from a security system sensor. As described above, the sensor can be, for example, a movement or displacement sensor. Each sensor can include an independent battery backup maintaining operation of the sensor after a power failure. When a sensor is triggered, for example a motion sensor senses movement, the sensor notifies the security management device using an RF communication. The security management device includes an RF receiver that receives the incoming signal.

In response to the received sensor alert, the security management device one or more communication modules are powered up and a command is sent to an associated IP camera to capture content (425). The one or more communication modules can be powered up as described above with respect to FIG. 3. In addition, the activated WiFi module is used to receive video content from the IP camera.

In particular, the IP camera powers up in response to the command. The IP camera can be one that is nearby or that captures a view corresponding to the location of the triggered sensor. Upon powering up, the IP camera captures a specified amount of video footage. In some implementations, the complete video footage is transmitted using WiFi to the security management device. In some other implementations, a set of video still images are extracted from the captured video content and transmitted.

After receiving the video content, the security management device transmits an alarm and the video content to a service provider system (430). In particular, the management module can activate switches necessary to provide power and communication to one or more particular communication modules needed to transmit the alarm. For example, the security management device can close one or more switches sending power back to the cellular communication circuitry, e.g., a 3G or 4G dongle. Alternatively, the dongle can provide another form of cellular data communication. The security management device may also need to switch on a USB hub to allow the management module to communicate with the 3G or 4G dongle. However, in other implementations the communication module is directly wired to the management module. The management module then uses the activated 3G or 4G dongle to transmit information about the alarm to a service provider system as well as the received video content from the IP camera.

After the alarm and video content has been transmitted, the security management device returns to the low power state (435). In addition, the security management device can send a command to the IP camera to also return to the low power state. When the security management device detects that the AC power has been restored, the security management device returns to a normal power state (440).

Embodiments of the subject matter and the functional operations described in this specification can be implemented in digital electronic circuitry, in tangibly-embodied computer software or firmware, in computer hardware, including the structures disclosed in this specification and their structural equivalents, or in combinations of one or more of them. Embodiments of the subject matter described in this specification can be implemented as one or more computer programs, i.e., one or more modules of computer program instructions encoded on a tangible non-transitory program carrier for execution by, or to control the operation of, data processing apparatus. The computer storage medium can be a machine-readable storage device, a machine-readable storage substrate, a random or serial access memory device, or a combination of one or more of them.

The term "data processing apparatus" encompasses all kinds of apparatus, devices, and machines for processing data, including by way of example a programmable processor, a computer, or multiple processors or computers. The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, or a combination of one or more of them.

The processes and logic flows described in this specification can be performed by one or more programmable computers executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application-specific integrated circuit).

Computers suitable for the execution of a computer program include, by way of example, can be based on general or special purpose microprocessors or both, or any other kind of central processing unit. Generally, a central processing unit will receive instructions and data from a read-only memory or a random access memory or both. The essential elements of a computer are a central processing unit for performing or executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device, e.g., a universal serial bus (USB) flash drive, to name just a few.

Computer-readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

While this specification contains many specific implementation details, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system modules and components in the embodiments described above should not be understood as requiring such separation in all embodiments, and it should be understood that the described program components and systems can generally be integrated together in a single software product or packaged into multiple software products.

Particular embodiments of the subject matter have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In certain implementations, multitasking and parallel processing may be advantageous.

What is claimed is:

1. A method comprising:

determining a loss in electricity to a security system management device;

entering a low power state using a backup power source, wherein the low power state includes powering down one or more communication modules for communicating with a remote service provider system;

receiving a wireless sensor alert from a sensor associated with the security system management device while the security system management device is in the low power state;

in response to receiving the wireless sensor alert:

returning at least one of the one or more communication modules to a normal power state to transmit an alarm to the remote service provider system, and returning the at least one communication module of the security system management device to the powered down state after transmitting the alarm; and returning the security system management device to normal power state when electricity is restored.

2. The method of claim 1, wherein entering the low power state comprises powering down one or more of a cellular communications, WiFi, Ethernet, WIMAX or other wireless/wired networking modules.

3. The method of claim 1, wherein the wireless sensor alert is a radio frequency alert received from one or more security sensors.

4. The method of claim 3, wherein the sensors include one or more of movement or displacement sensors.

5. The method of claim 1, wherein entering the low power state comprises closing respective switches to the one or more communication modules.

6. The method of claim 1, wherein the security system management device includes a USB hub coupling the one or more communication modules to a management module and wherein entering low power mode comprises disconnecting the USB hub and communication modules from a battery backup for the security system management device.

7. The method of claim 6, wherein transmitting the alarm to the service provider system includes selectively activating at least one of the communication modules to transmit the alarm.

8. A method comprising:

determining a loss in electricity to a security system management device;

transmitting a message to one or more wireless enabled devices associated with the security system management device to enter a low power state;

entering a low power state for the security system management device using a backup power source, wherein the low power state includes powering down one or more communication modules for communicating with a remote service provider system;

receiving a wireless sensor alert from one of the one or more wireless enabled devices while the security system management device is in the low power state;

in response to receiving the wireless sensor alert:

returning at least one of the one or more communication modules to a normal power state, transmitting a message to a wireless camera device to capture content, receiving captured wireless camera content, transmitting an alarm to a remote service provider system including transmitting the captured wireless camera content, and returning the at least one communication module of security system management device to the powered down state after transmitting the alarm; and returning the security system management device to the normal power state when electricity is restored.

9. The method of claim 8, wherein entering the low power state comprises powering down one or more of a cellular communications, WiFi, Ethernet, WIMAX or other wireless/wired networking modules.

10. The method of claim 8, wherein the wireless sensor alert is a radio frequency alert received from one or more security sensors.

11. The method of claim 10, wherein the sensors include one or more of movement or displacement sensors.

12. The method of claim 8, wherein entering the low power state comprises closing respective switches to the one or more communication modules.

13. The method of claim 8, wherein the security system management device includes a USB hub coupling one or more communication modules to a management module and wherein entering low power mode comprises disconnecting the USB hub and communication modules from a battery backup for the security system management device.

14. A security system management device comprising:

a management module configured to provide security and power management to a security system;

one or more communication modules coupled to the management module;

an RF transmitter/receiver configured to communicate with wireless enabled security devices communicatively coupled to the security system;

a battery backup power supply; and a plurality of switches, the one or more switches positioned in an electrical path of each of the communication modules, wherein the management module is configured to control the plurality of switches in a low power state to selectively cut battery power to the communication modules and to selectively reconnect one or more of the communication modules to the battery backup power in response to receiving an alert from one of the wireless enabled security devices.

* * * * *